United States Patent [19]

Breitkreuz

[11] 3,947,720

[45] Mar. 30, 1976

[54] PULSED FLASH TUBE REGULATOR USING THYRISTOR GATE CONTROL

[75] Inventor: Lutz Breitkreuz, Berlin, Germany

[73] Assignee: Loewe-Opta GmbH, Berlin, Germany

[22] Filed: Mar. 30, 1972

[21] Appl. No.: 239,772

Related U.S. Application Data

[63] Continuation-in-part of Ser. No. 17,841, March 9, 1970, abandoned.

[30] Foreign Application Priority Data

Mar. 8, 1969 Germany ..... 1911832

[52] U.S. Cl. ..... 315/151; 315/159; 315/241 P

[51] Int. Cl.[2] ..... H05B 37/02

[58] Field of Search ..... 307/252 C; 315/149, 151, 315/159, 241 P, 241 R

[56] References Cited

UNITED STATES PATENTS

| | | | |
|---|---|---|---|
| 3,525,033 | 8/1970 | Greenburg et al. | 307/252 C X |
| 3,591,829 | 7/1971 | Murata et al. | 315/151 |
| 3,818,266 | 6/1974 | Vital et al. | 315/151 |

*Primary Examiner*—R. V. Rolinec
*Assistant Examiner*—Lawrence J. Dahl

[57] ABSTRACT

A first thyristor gate whose conductive state is determined by the polarity of a signal applied to its control electrode is connected in series with a flash tube for selectively coupling operating voltage from a flash capacitor to the tube. The first gate is opened by a signal of a first polarity derived from the operating voltage source and generated in synchronism with an ignition pulse, which is applied to the trigger electrode of the flash tube to energize the tube. An integrating circuit energized by a transformer coupled to the flash tube output contains a photosensitive element responsive to a portion of the emitted light for developing a control voltage that increases in proportion to the total light integrated. When the output voltage from the integrating circuit reaches a predetermined value, a second thyristor gate whose control electrode is coupled to the output of the integrating circuit is opened to apply a signal of the opposite polarity to the control electrode of the first thyristor gate. This closes the first gate and disables the flash tube.

7 Claims, 1 Drawing Figure

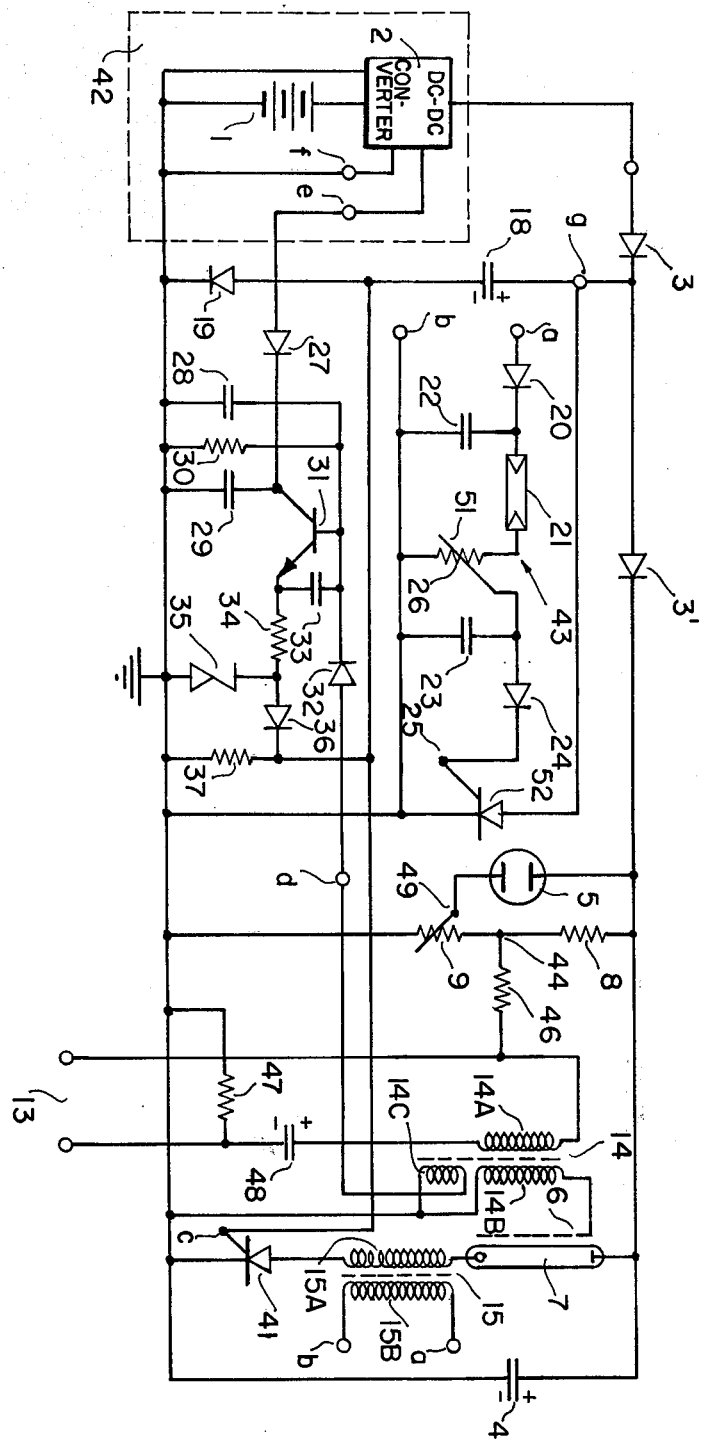
DC-DC
CON-
VERTER

PULSED FLASH TUBE REGULATOR USING THYRISTOR GATE CONTROL

CROSS-REFERENCE TO RELATED APPLICATION

This case is a continuation-in-part of applicant's co-pending co-assigned application Ser. No. 17,841, filed Mar. 9, 1970 and entitled "Pulsed Flash Tube Regulator Using Thyristor Gate Control", now abandoned.

BACKGROUND OF THE INVENTION

Conventional devices which automatically adjust the operating duration of a flash tube to obtain a predetermined quantity of emitted light employ a controllable switch (generally a quench tube of the gas discharge type), which is connected in shunt with the flash tube and triggered into conduction when the integrated light derived from the emission of the flash tube has reached a predetermined value. When the quench tube conducts, the exciting energy from flash capacitor bypasses the flash tube and is dissipated in the quench tube.

The portion of the available energy for the flash tube that is dissipated in the quench tube represents wasted energy, i.e. energy that does not result in useful light output. Also, the successive charging and recharging of the flash capacitor to and from a completely or nearly completely discharged state following each flash and quench operation limits the maximum repetitive speed of the device and increases its recycling time.

One manner of overcoming this disadvantage was proposed in the co-pending, co-assigned application Ser. No. 874,935 filed Nov. 7, 1969, now U.S. Pat. No. 3,612,947. A first thyristor gate, of the "interruptible" type that can be switched both on and off by pulses of respectively opposite polarity applied to a control electrode thereof, is interposed in the energizing path of the flash tube. The thyristor gate is opened to switch the flash tube on by a Schmitt trigger on similar bipolar threshold device which is excited by a reference voltage derived from an ignition pulse applied to a trigger electrode of the flash tube. A photosensitive element operatively associated with the light output of the flash tube generates a control signal that varies in proportion to the amount of light integrated. The Schmitt trigger is also coupled to the output of the integrating circuit in such a manner that when the control signal developed at the output of the integrating circuit has reached a predetermined value sufficient to overcome the previously established reference voltage at the input of the Schmitt trigger, the output polarity of the latter reverses to reclose the thyristor gate and terminate the flash.

SUMMARY OF THE INVENTION

An alternative technique for overcoming the flash inefficiency and recycling time problems inherent in the use of shunting quench tubes is provided by the instant invention. In an illustrative embodiment, a first interruptible thyristor gate is connected in the energizing path of the flash tube for selectively coupling operating voltage thereto when the gate is opened by a voltage pulse of a first polarity. Such pulse is provided via a switching circuit coupled to the flash tube energizing circuit, in response to an ignition pulse applied to the flash tube trigger electrode. A primary winding of an output transformer associated with the output of the flash tube thereupon produces an energizing voltage for an integrating circuit of the type described above. The integrating circuit in turn generates a control voltage proportional to the integrated light. A second control thyristor has its control electrode operatively connected to the output of the integrating circuit for triggering the second thyristor into conduction when the control voltage reaches a specified value. The conductive second thyristor couples a voltage pulse of the opposite polarity to the control electrode of the first thyristor gate in the flash tube circuit for disabling the flash tube.

BRIEF DESCRIPTION OF THE DRAWING

The nature of the invention and its advantages will appear more fully from the following detailed description taken in conjunction with the appended drawing, whose single FIGURE is a circuit diagram of a thyristor-controlled flash tube excitation circuit constructed in accordance with the invention.

DETAILED DESCRIPTION

Referring now to the drawing, there is illustrated a conventional flash tube 7 (illustratively a gas-filled envelope) which is coupled, through a primary winding 15A of a transformer 15 and the transconductive path of a first thyristor gate 41, across the terminals of a flash capacitor 4. The capacitor 4 may be selectively charged to a relatively high positive potential from a D.C. power source 42. As shown, the lower terminal of the capacitor 4 and the cathode of the gate 41 are at ground potential.

The flash tube 7 is further provided with a trigger electrode 6 which is coupled to a first secondary winding 14B of an ignition transformer 14. An ignition pulse may be applied to the electrode 6 through the transformer 14 in a known manner by closing a pair of contacts 13 associated with a primary winding 14A of the transformer 14.

The voltage of the charged flash capacitor 4, which is coupled to the flash tube 7 when the gate 41 is opened as described below, is not normally sufficient by itself to cause emission of light energy from the tube 7. However, as described below, such tube will emit light upon the concurrent application of an igniting pulse to the trigger electrode 6 through the ignition transformer 14. The resulting flash of light energy produced in the tube 7 is emitted through the walls of the envelope toward a suitable object (not shown). A portion of the light reflected from the object is detected by a photosensitive element 21, illustratively a light sensitive resistor, which is connected in an integrating circuit 43 as hereafter described.

The D.C. power source 42 includes a relatively low potential battery 1, whose voltage is stepped up by a conventional D.C. to D.C. converter 2. The relatively high positive voltage at the output of the converter 2 is applied through a pair of diodes 3 and 3' to the flash capacitor 4. The converter 2 is also provided with auxiliary outputs on a pair of terminals *e* and *f*. The terminal e is positive with respect to the terminal f, which is grounded.

A junction (designated terminal *g*) between the diodes 3 and 3' is connected to the upper terminal of an auxiliary capacitor 18. The capacitor 18 is in series with an isolating diode 19, whose cathode is grounded. The diode 19, which is maintained in a non-conductive state, serves to hold a junction C between it and the capacitor 18 off ground so that such junction can be made either positive or negative with respect to ground in the manner indicated below.

The flash tube energizing voltage on the flash capacitor 4 is also coupled to the primary winding 14A of the ignition transformer 14 through (1) a resistor 8 of an adjustable voltage divider 44 that is connected across the capacitor 4; (2) a second pair of resistors 46 and 47; and (3) a capacitor 48. Thus, prior to ignition of the flash tube 7, a relatively high positive voltage is stored with the polarity indicated across the capacitor 48.

The voltage across the flash capacitor 4 also operates a conventional indicator lamp 5 which indicates readiness for flash in a known manner. The indicator lamp 5 is coupled as shown between the upper terminal of the resistor 8 and a wiper 49 of an adjustable resistor 9 in the voltage divider 44.

The gate 41 is illustratively a cut-off or interruptible thyristor. The latter differs from an ordinary thyristor of the thyratron type, in which a pulse applied to a control electrode thereof, after initiating conduction in the transconductive path of the device, is thereafter ineffective to return the device to its nonconductive state. In an interruptible thyristor by contrast, the transconductive path, once rendered conductive by the application of a pulse of a first polarity to its control electrode, may subsequently be cut-off by the application to the same control electrode of a pulse of the opposite polarity. In the particular arrangement shown in the drawing, the gate 41 may be the normally disabled cut-off thyristor designated as Model BT 103 by the International Telephone and Telegraph Co. Such a device will open to couple energizing voltage from the flash capacitor 4 to the tube 7 when the control electrode of the gate exhibits one polarity (illustratively positive) with respect to ground and will thereafter re-close to disable the tube 7 when the control electrode exhibits the opposite polarity (illustratively negative) with respect to ground. The control electrode of the gate 41 is connected to the above-mentioned junction C.

A resistor 37, whose upper terminal is connected to the junction C, is also connected across the terminals e and f of the DC power supply 42 through a pair of diodes 27 and 36, a resistor 34, and the collector-emitter path of a normally disabled transistor switch 31. The base of the transistor 31 is coupled via a diode 32 to a terminal d of an auxiliary secondary winding 14C of the ignition transformer 14, which is initially unenergized.

Upon the momentary shorting of the contacts 13, the primary winding 14A of the transformer 14 is short-circuited through the capacitor 48 to cause the capacitor 48 to discharge through the winding 14A. The resulting transient through the winding 14A causes a switching pulse to be developed at the terminal d via the secondary winding 14C. The pulse at terminal d turns on the transistor switch 31 to permit the control electrode C to assume a positive voltage with respect to ground and thereby open the gate 41. The positive voltage on the control electrode is maintained by the storage and stabilizing effect of (1) a capacitor 29 connected between the cathode of the diode 27 and terminal *f*, and (2) a Zener diode 35 connected between the junction of the resistor 34 and the diode 36 and terminal *f*.

The transient through the winding 14A caused by shortcircuiting the contacts 13 also causes the application of an ignition pulse to the trigger electrode 6 of the flash tube via the secondary winding 14B of the transformer 14. As a result, the tube 7, whose main terminals are simultaneously energized through the now-open gate 41, is triggered into conduction to commence the emission of light energy toward the object to be illuminated.

The sudden conduction of the tube 7 causes a pulse of current through the primary winding 15A of the transformer 15 in series therewith, thereby generating a corresponding voltage pulse across terminals *a-b* of a secondary winding 15B of the transformer 15. The terminal *b* is grounded as shown. Such voltage pulse is coupled to the input of the integrating circuit 43 through a diode 20.

The integrating circuit 43 includes the combination of the photosensitive element 21 and an adjustable resistor 26 serially connected across an input capacitor 22. An output capacitor 23 is coupled between a tap point 51 of the resistor 26 and the terminal b.

The resistance of the photosensitive element 21 is substantially lowered from a normally high value in response to reflected light from the object illuminated by the flash tube 7, so that the capacitor 23 charges through the element 21 and the resistor 26 to a voltage proportional to the total amount of light integrated.

The integrating circuit 43 controls the conductive state of a second thyristor 52 whose transconductive path, when enabled as described below, connects the terminal g of the D.C. power source 42 to the grounded cathode of the thyristor gate 41. At the same time, point *c*, which because of the charge on the capacitor 18 is negative relative to point *g*, remains coupled to the control electrode of the gate 41. This action effectively makes such control electrode negative with respect to ground, thereby re-closing the gate 41.

To accomplish this result, a control electrode 25 of the second thyristor 52 is connected to the output of the integrating circuit 43 via a diode 24. The diode 24 and/or the thyristor 52 may be selected (or biased by suitable clamping means not shown) so that the control electrode 25 is triggered only when the output of the integrating circuit 43 reaches a predetermined value indicative of a desired amount of total light energy reflected from the illuminated object and detected by the photosensitive element 21. With this arrangement, when the light flash has persisted for a duration long enough to effect a positive voltage build-up on capacitor 23 to a value equal to the required trigger voltage on the control electrode 25, the transconductive path of the thyristor 52 is enabled to connect point *g* to the ground cathode of the thyristor gate 41 in the flash tube circuit, thereby causing point *c* to assume the required negative potential to close the gate. The resultant disabling of the tube 7 stops the emission of light, and the action of the integrating circuit 43 is also terminated by the restoration of the high impedance of the photosensitive element 21.

It will be noted that the above-described apparatus employs only so much of the energy stored on the flash capacitor 4 as is necessary to produce useful emitted light from the flash tube 7. In most instances, this will represent an incomplete discharge of the flash capacitor 4. Thus, the time necessary to restore full voltage on the capacitor 4 from the D.C. power supply 42 in the interval between successive flashes can be relatively short compared to the time necessary to fully recharge the capacitor 4 from a completely discharged state. It will be recognized that this latter state is generally reached in prior art arrangements by the use of a quench tube in parallel with the flash tube. Hence, rapid and efficient operation of the flash unit is assured with the instant arrangement.

What is claimed is:

1. Apparatus for automatically adjusting the operating duration of a triggerable flash tube to obtain a controllable quantity of light energy therefrom which comprises:

first means including a normally closed controllable gate serially connected with the flash tube for applying operating voltage to the flash tube when the gate is open, the gate having a control electrode responsive to signals of one polarity for opening the gate and responsive to signals of the opposite polarity for closing the gate;

second means for selectively applying an igniting pulse to the trigger electrode of the flash tube, the tube being operated by the simultaneous application thereto of operating voltage and an igniting pulse;

third means responsive to the application of the igniting pulse to the trigger electrode for applying a signal of the one polarity to the control electrode of the gate to open the gate;

means coupled to the first applying means and rendered effective upon the operation of the flash tube for generating a control signal that varies in proportion to the total light energy emitted from the flash tube;

fourth means including a thyristor having a normally disabled transconductive path for reversing the polarity of the signal applied to the control electrode of the gate by the third applying means when the transconductive path of the thyristor is enabled, the thyristor having a control electrode triggerable when a voltage applied thereto is at least a predetermined value for enabling the transconductive path of the thyristor; and means for coupling the output of the generating means to the control electrode of the thyristor.

2. Apparatus as defined in claim 1, in which the generating means, comprises, in combination, integrating means including a photosensitive element in operative relation to the light emitted from the flash tube, and means for coupling the output of the flash tube to the input of the integrating means.

3. Apparatus as defined in claim 1, in which the third applying means comprises, in combination, a normally disabled transistor for coupling the signal of the one polarity to the control electrode of the gate, and means coupled to the second applying means for enabling the transistor upon the occurrence of an igniting pulse.

4. Apparatus as defined in claim 3, in which the second applying means comprises an ignition transformer having a primary winding coupled to a source of the igniting pulses, a first secondary winding coupled to the trigger electrode of the flash tube, and an auxiliary secondary winding; and in which the enabling means comprises means for coupling the auxiliary secondary winding of the ignition transformer to the base of the transistor.

5. Apparatus as defined in claim 3, in which the apparatus further comprises means for coupling the collectoremitter path of the transistor to the first applying means for receiving the signal of the one polarity therefrom.

6. In an electronic timing apparatus wherein the duration of light energy emitted from a flash tube is regulated to produce a predetermined quantity of emitted light energy:

first means including a normally closed controllable gate serially connected with the main electrodes of the flash tube for applying operating voltage to the main electrodes when the gate is open, the gate having a control electrode responsive to signals of one polarity for opening the gate and responsive to signals of the opposite polarity for closing the gate;

second means for selectively applying an igniting pulse to the trigger electrode of the flash tube, the tube being operated to emit light by the simultaneous application thereto by operating voltage and of an igniting pulse;

third means responsive to the application of the igniting pulse to the trigger electrode for applying a signal of the one polarity to the control electrode to open the gate;

a transformer;

means for connecting the primary winding of the transformer in series to the output of the flash tube;

integrating means including a photosensitive element in operative association with the light emitted from the flash tube;

means for coupling the secondary winding of the transformer to the input of the integrating means for energizing the latter to produce a control voltage that varies in proportion to the light energy emitted from the flash tube;

fourth means including a control thyristor having a normally disabled transconductive path for reversing the polarity of the signal applied to the gate by the third applying means when the transconductive path of the control thyristor is enabled, the control thyristor having a control electrode triggerable when a voltage applied thereto reaches a predetermined value for enabling the transconductive path of the control thyristor; and means for coupling the output of the integrating means to the control electrode of the control thyristor.

7. In an electronic timing apparatus wherein the duration of light energy emitted from a flash tube is regulated to produce a predetermined quantity of emitted light energy:

a source of operating voltage;

a normally closed controllable gate serially connected with the voltage source and the main electrodes of the flash tube and operative when opened to supply operating voltage to the main electrodes, the gate having a control electrode responsive to signals of one polarity for opening the gate and responsive to signals of the opposite polarity for closing the gate;

means for selectively applying an igniting pulse to the trigger electrode of the flash tube;

a normally disabled switch having an output connected to the control electrode of the gate;

means for connecting the input of the switch to a predetermined terminal of the operating voltage source for applying a voltage of the one polarity occurring at said terminal to the input of the switch;

means responsive to the application of the igniting pulse to the trigger electrode for enabling the switch to couple the voltage of the one polarity to the control electrode of the gate to open the gate and to operate the flash tube so that the latter emits light;

means rendered effective upon the operation of the flash tube for generating a control signal that varies in proportion to the total light energy emitted from the flash tube;

means including a thyristor having a normally disabled transconductive path for reversing the polarity of the voltage at said predetermined terminal when said transconductive path is enabled and for applying the resulting signal of the opposite polarity to the control electrode of the gate, the thyristor having a control electrode triggerable when a voltage applied thereto is at least a predetermined value for enabling the transconductive path of the thyristor; and means for coupling the output of the control signal generating means to the control electrode of the thyristor.

* * * * *